US005813087A

United States Patent [19]

Huffman

[11] Patent Number: 5,813,087

[45] Date of Patent: Sep. 29, 1998

[54] SPRAY NOZZLE FOR USE WITH WATER EXTRACTION CLEANING MACHINE

[75] Inventor: Eric C. Huffman, Lowell, Mich.

[73] Assignee: Bissell Inc., Grand Rapids, Mich.

[21] Appl. No.: 635,557

[22] Filed: Apr. 22, 1996

Related U.S. Application Data

[60] Provisional application No. 60/003,416 Sep. 8, 1995.

[51] Int. Cl.[6] ..... A47L 7/00

[52] U.S. Cl. ..... 15/321; 15/322; 239/521

[58] Field of Search ..... 15/321, 322; 239/499, 239/504, 518, 521, 523, 524

[56] References Cited

U.S. PATENT DOCUMENTS

| | | | |
|---|---|---|---|
| 868,715 | 10/1907 | Skinner . | |
| 1,177,884 | 4/1916 | Molesta et al. | 239/523 |
| 1,559,655 | 11/1925 | Thompson . | |
| 1,954,863 | 4/1934 | Coles et al. . | |
| 2,626,836 | 1/1953 | Herron . | |
| 2,721,764 | 10/1955 | Wilson, Jr. . | |
| 2,896,865 | 7/1959 | Hamilton . | |
| 3,896,521 | 7/1975 | Parise | 15/322 X |
| 4,074,387 | 2/1978 | Arato et al. . | |
| 4,075,733 | 2/1978 | Parise et al. . | |
| 4,130,247 | 12/1978 | Healy | 239/523 |
| 4,137,600 | 2/1979 | Albishausen | 15/322 |
| 4,202,072 | 5/1980 | Gonzales . | |
| 4,231,521 | 11/1980 | Hermine | 239/523 X |
| 4,329,756 | 5/1982 | Chicoine et al. . | |
| 5,398,373 | 3/1995 | Blase et al. . | |

*Primary Examiner*—Chris K. Moore
*Attorney, Agent, or Firm*—Rader, Fishman, Grauer & McGarry

[57] ABSTRACT

Spray nozzles are frequently used for distributing pressurized fluid onto a surface to be cleaned. The spray nozzle according to the invention is ideally suited for use with a water extraction cleaning machine and for distributing a fan-shaped spray pattern onto the surface to be cleaned. The spray nozzle includes a nozzle body with a fluid flow path extending therethrough. An arcuate deflector plate is provided a spaced distance from the outlet of the fluid flow path. A pinpoint spray of pressurized cleaning solution is directed onto the downwardly and outwardly extending concave deflector surface for creating a fan-shaped spray pattern. The contour of the concave deflector surface can comprise a variety of concave surfaces such as a cylindrical surface, a parabolic surface and a hyperbolic surface. The incorporation of a concave deflector surface is ideally suited for containing and controlling the spray pattern for increasing fluid flow rates and pressures.

18 Claims, 3 Drawing Sheets

SPRAY NOZZLE FOR USE WITH WATER EXTRACTION CLEANING MACHINE

This application claims the benefit of U.S. Provisional Application No. 60/003,416 filed on Sep. 8, 1995.

BACKGROUND OF THE INVENTION

1. Field of the Invention

This invention relates to water extraction cleaning machines and, more specifically, to a spray nozzle adapted to distribute a flow of pressurized cleaning solution onto a surface to be cleaned.

2. Description of the Related Art

Water extraction cleaning machines have long used spray nozzles for distributing pressurized cleaning solution onto a surface to be cleaned. These water extraction cleaning machines include small, compact canister-type machines as disclosed in U.S. Pat. No. 5,237,720 issued Aug. 24, 1993 to Blase et al.; canister-type cleaning units as disclosed in U.S. Pat. No. 5,398,373 issued Mar. 21, 1995 to Blase et al.; upright cleaning machines as disclosed in U.S. Pat. No. 5,406,673 to Bradd et al.; and industrial-type machines as disclosed in U.S. Pat. No. 4,956,891 issued Sep. 18, 1990 to Wulff.

In these several different water extraction cleaning machines, a spray nozzle is typically mounted at one end of the solution conduit, the other end being mounted to means for pressurizing the cleaning solution. The spray nozzle typically comprises a circular body with a hollow interior with an inlet formed on one end and an outlet formed on the other end. Typically, the outlet is smaller than the inlet so that a back pressure is created inside the chamber. A planer deflector plate is typically provided adjacent the outlet and is adapted to create a fan-shaped spray pattern and direct the spray pattern onto the surface to be cleaned.

One problem with this known structure is the ability to create a controlled, focused spray pattern. This pattern is not uniform along the length of the pattern in that more cleaning solution is concentrated near the centerpoint of the pattern than the opposite ends of the spray pattern. This results in inefficient and unequal cleaning performance for the cleaning machine.

As a general rule, distribution of a greater amount of cleaning solution up to a certain amount onto the surface to be cleaned will result in more effective cleaning. One way to increase the volume of cleaning solution distributed is to increase the pressure of the water as supplied by the source of pressurized cleaning solution. Unfortunately, increasing the fluid pressure for a conventional spray nozzle with a substantially planar deflector plate correspondingly results in a greater width for the fan-shaped spray pattern. The expansion of the fan-shaped spray pattern defeats the goal of increasing the volume of cleaning solution applied to the surface. Therefore, another problem with the prior art spray nozzles is the ability to increase the cleaning performance through increasing fluid pressure.

SUMMARY OF THE INVENTION

The spray nozzle, according to the invention, overcomes the problems of the prior art by creating a focused, fan-shaped spray pattern in which the distribution of cleaning solution along the length of the spray pattern is more uniform than the prior art spray patterns and controllable at greater and greater fluid pressures.

According to the invention, a spray nozzle is adapted to receive fluid under pressure from a suitable source and distribute the fluid in the desired spray pattern. The nozzle comprises a nozzle body having a bore therethrough with an inlet opening and an outlet opening forming a flow path. A deflector surface is positioned in spaced confronting relationship with the outlet opening for deflecting a fluid stream under pressure from the outlet opening into a spray pattern on a surface to be cleaned. A spray opening is positioned beneath the bore outlet and adjacent the deflector surface for passage of liquid in a spray pattern deflector from the deflector surface. According to the invention, the deflector surface is concave toward the bore outlet opening.

Preferably, the bore has a longitudinal axis and the concave deflector surface is defined by rotating an element of the deflector surface about an axis of rotation which is at an obtuse angle to the longitudinal axis of the bore. In one embodiment, the concave surface is defined by rotating an element of the surface through a circular arc. In another embodiment, the concave surface is defined by rotating the element of the surface through a parabolic curve. In still another embodiment, the concave surface is defined by rotating the element of the surface through a hyperbolic curve.

In a preferred embodiment of the invention, the radius of curvature of the circular arc is in the range of 0.1 to 10 inches. Further, the angle of the element of the surface with respect to the longitudinal axis of the bore is in the range of 0° to 90°.

In a preferred embodiment, the bore decreases in cross-sectional area between the inlet and outlet openings which results in a high pressure narrow stream of liquid which impinges on the deflector surface.

The spray nozzle according to the invention is incorporated into a water extraction cleaning machine having a source of pressurized cleaning solution, a vacuum motor for generating a working air flow, a reservoir for retaining used cleaning solution and dirt and dust entrained therein, and a vacuum hose having one end in fluid communication with a vacuum motor through the reservoir. A solution conduit has one end in fluid communication with a source of pressurized cleaning solution. A cleaning tool is mounted to the other end of the vacuum hose and has a suction nozzle in fluid communication with a vacuum hose. The spray nozzle according to the invention as described above is mounted to the cleaning tool for depositing a spray pattern of pressurized cleaning solution adjacent to the suction nozzle. The spray nozzle inlet opening is connected to the solution conduit.

BRIEF DESCRIPTION OF THE DRAWINGS

The invention will now be described with reference to the drawings in which.

DETAILED DESCRIPTION OF THE PREFERRED EMBODIMENTS

Figure 1:
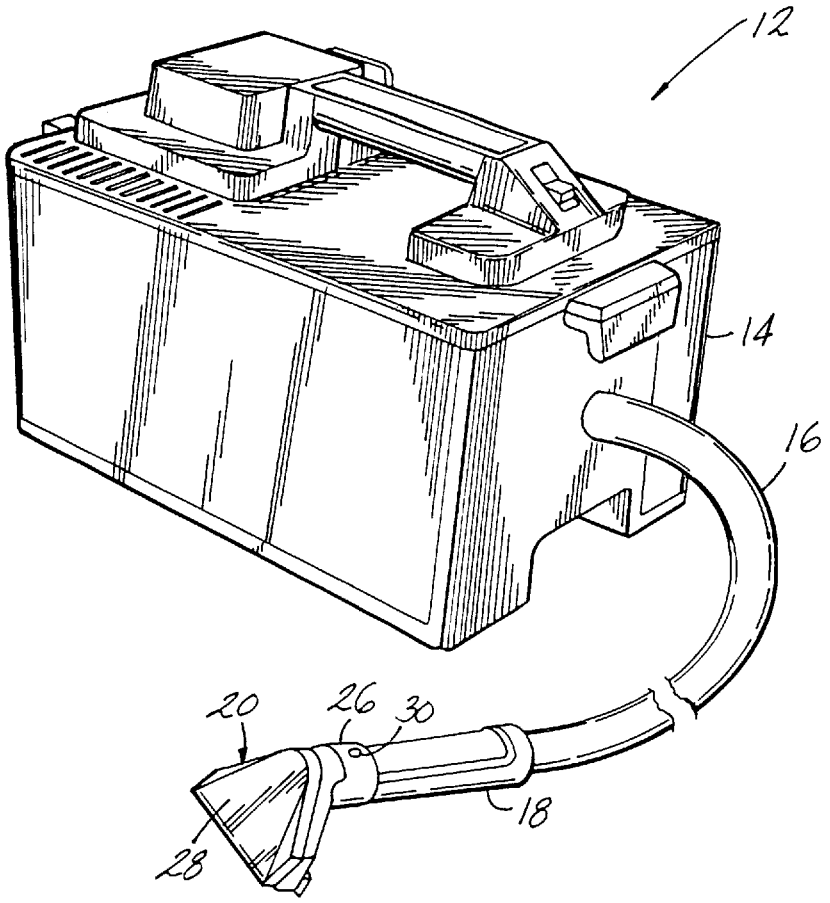
FIG. 1 is a perspective view of a water extraction cleaning machine incorporating a spray nozzle according to the invention.

Referring now to FIG. 1, a water extraction cleaning machine 12 according to the invention comprises a housing 14, a flexible hose 16 mounted at one end to the housing and a grip tube 18 mounted to the other end of the flexible hose 16. A cleaning tool 20 is selectively mounted to the distal end of the grip tube 18. The cleaning machine 12 includes a clean solution reservoir and means such as a pump (not shown) for conveying pressurized cleaning solution from the machine 12 to the grip tube 18 and cleaning tool 20. A trigger 22 is provided on the grip tube 18 for dispensing the pressurized cleaning solution. A flexible solution conduit 24 extends from the cleaning tool 20, through the grip tube 18, to the housing 14. In the cleaning machine 12 shown in FIG. 1, the solution conduit extends through the inside of the flexible hose 16. However, the solution conduit can also be provided on the outside of the vacuum hose and retained thereon by clips. A vacuum motor (not shown) is provided inside the housing 14 to create a working air flow for removing the used cleaning solution along with any entrained dirt and dust from the surface being cleaned. The dirty solution flows through the cleaning tool 20, the grip tube 18, and the flexible hose 16 to a suitable reservoir (not shown) provided in the housing 14.

The particular water extraction cleaning machine 12 shown in FIG. 1 is a small, compact cleaning machine and is described more fully in U.S. Pat. No. 5,237,720 issued Aug. 24, 1993 to Blase et al. which is expressly incorporated herein by reference. It is to be understood that the spray nozzle disclosed herein can be utilized with any fluid distribution machine in which pressurized solution is distributed from a spray nozzle such as that disclosed in U.S. Pat. No. 5,398,373 to Blase et al., U.S. Pat. No. 5,406,673 to Bradd et al., and U.S. Pat. No. 4,956,891 to Wulff. The preferred use for the spray nozzle according to the invention is with a water extraction cleaning machine. However, the spray nozzle can be used in a wide variety of other applications for the controlled distribution of pressurized cleaning solution.

Figure 2:
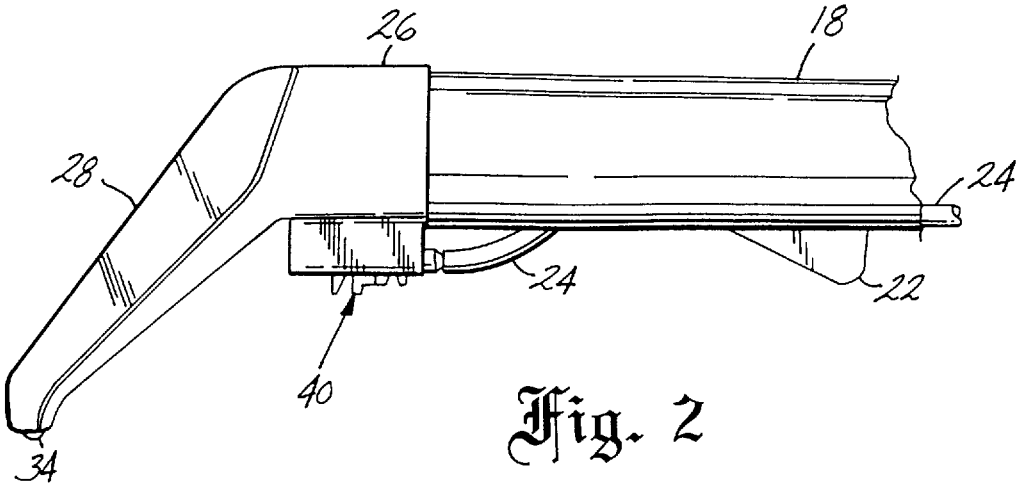
FIG. 2 is a side-elevational view of the spray cleaning tool incorporating a spray nozzle according to the invention.

The cleaning tool 20 (shown in FIGS. 1 and 2) is a spot or upholstery cleaning tool utilized for cleaning relatively small areas. The cleaning tool comprises a tubular body portion 26, one end of which is adapted to telescopically receive the grip tube 18. The cleaning tool is retained on the grip tube 18 by a spring-button 30 provided on the grip tube which is selectively received in a complementary aperture provided in the tubular body 26 of the cleaning tool. A flared nozzle section 28 extends outwardly and downwardly from the other end of the tubular body 26 to terminate at a substantially rectangular suction nozzle opening 34. The nozzle opening 34 opens up into the hollow interior of the flared nozzle section 28 which in turn opens up into the tubular body portion 26.

A spray nozzle 40 is mounted on the bottom surface of the tubular body portion and is adapted to direct a spray of pressurized cleaning solution onto the surface to be cleaned at a point behind the suction nozzle opening 34 of the cleaning tool 20. As is described further below, the spray nozzle 40 is fluidly connected to the solution conduit 24 extending through the grip tube 18 and flexible hose 16 to the machine housing 14.

Figure 3:
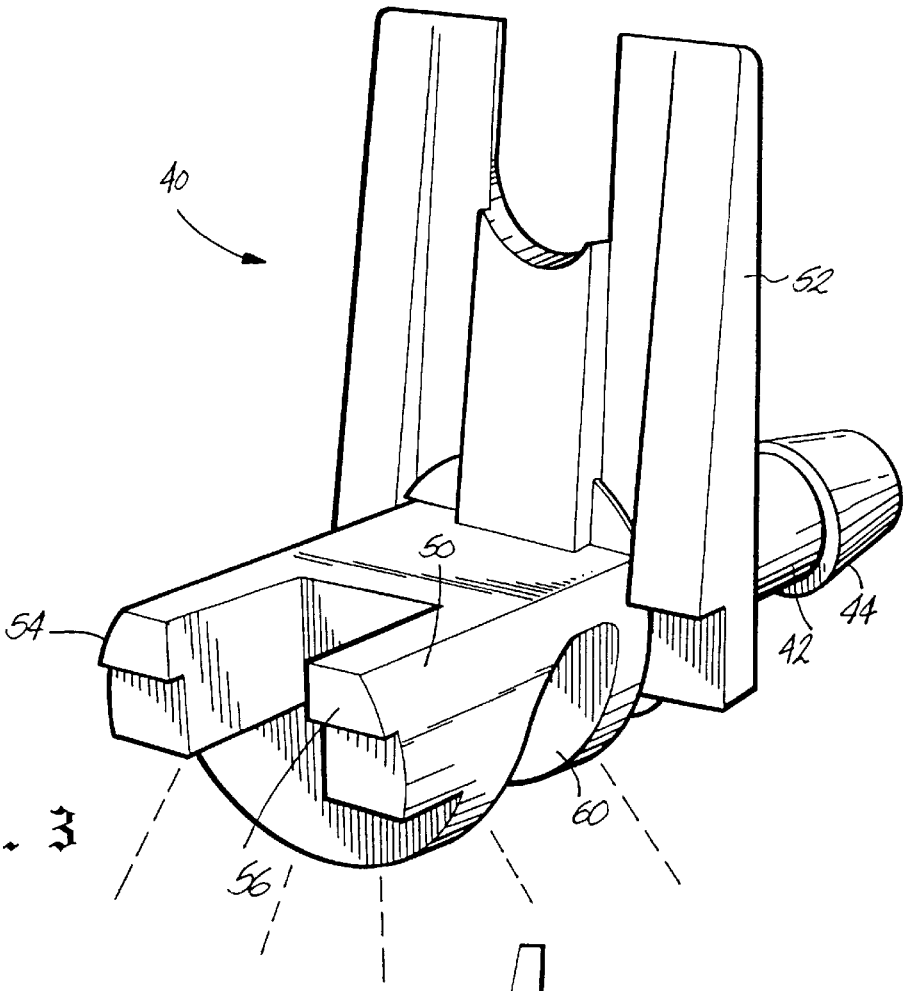
FIG. 3 is an enlarged front, perspective view of the spray nozzle shown in FIG. 2.
Figure 4:
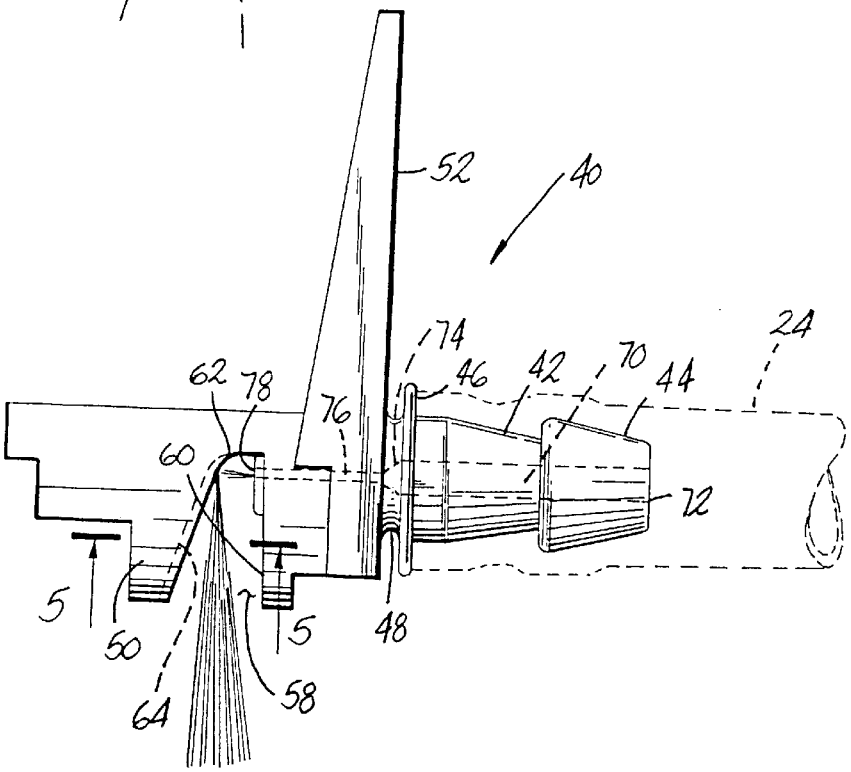
FIG. 4 is a side-elevational view of the spray nozzle of FIG. 3.
Figure 5:
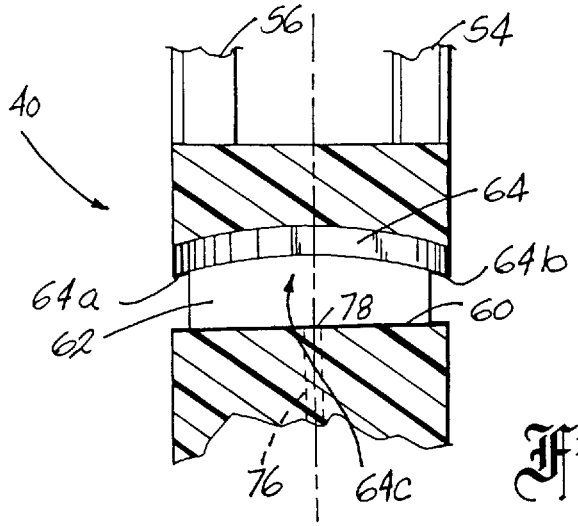
FIG. 5 is a cross-sectional view taken along lines 5—5 of FIG. 4.

As shown in FIGS. 3–5, the spray nozzle 40 comprises a conduit mounting portion 42 formed on one end which is adapted to be telescopically received inside the hollow interior of the solution conduit 24. The conduit mounting portion has a frusto-conical tip 44 adapted to retain the solution conduit 24 thereon. A collar 46 is provided at one end of the conduit mounting portion 42 and functions as a stop to limit the length of the conduit mounting portion 42 which is received inside the conduit 24. An annular groove 48 is provided immediately adjacent the collar 46. The groove 48 is adapted to receive one or more locking fingers or other conventional means for retaining the spray nozzle 40 to the cleaning tool. A partially tubular body portion 50 of the spray nozzle 40 extends forwardly from the collar 46 and groove 48. A mounting flange 52 extends upwardly from the body portion 50 adjacent the groove 48. The flange 52 is adapted to be received in the cleaning tool for mounting the spray nozzle 40 thereto. Similarly, a pair of axial mounting flanges 54, 56 extend from the end of the body portion 50 for mounting the spray nozzle 40 to the cleaning tool. The spray nozzle 40 depicted herein includes structural flanges and the like for mounting the spray nozzle to the cleaning tool. The means by which the spray nozzle is secured to the cleaning tool is not directly relevant to the invention and therefore will not be described in detail.

A fluid chamber 70 is provided inside the conduit mounting portion 42 and extends substantially the entire length thereof. The fluid chamber 70 has an opening 72 formed on the frusto-conical tip 44 and a reduced diameter shoulder 74 provided at the other end thereof, immediately adjacent the collar 46 and groove 48. The shoulder 74 joins a fluid bore 76 having a cross-sectional area smaller than the fluid chamber 70. The fluid bore 76 terminates at a nozzle opening 78 provided in the side wall 60. Preferably, the nozzle opening 78 is circular in cross section, spaced downwardly from the top wall 62 a short distance and aligned so that the longitudinal axis of the nozzle opening 78 is oriented at an obtuse angle with respect to the elements of the concave deflector surface 64.

A recess 58 is formed in the body portion 50 and opens to the bottom and sides of the body portion 50. The recess 58 is defined by a planar side wall 60, a top wall 62, and a concave deflector surface 64 spaced from the side wall 60. Preferably, the deflector surface 64 is concave toward the nozzle opening 78 and is formed as a cylindrical surface, defined by rotating an element of the deflector surface about an axis of rotation which is at an obtuse angle to the longitudinal axis of the bore 76. An element of the surface is a straight line in the surface. The deflector surface 64 comprises a first side edge 64*a* and a second side edge 64*b*, both of which define the lateral extent of the deflector surface. The deflector surface 64 further comprises an intermediate portion 64*c* disposed between the first side edge 64*a* and second side edge 64*b*. In the embodiment shown in FIG. 4 and 5, the elements of the surface are positioned at an acute angle to the vertical (an obtuse angle to the longitudinal axis of the bore 76), for example in the range of 0° to 45° away from the side wall 60 to deflect liquid from the nozzle opening 78 downwardly as viewed in FIG. 4. Stated another way, the elements of the surface 64 form an oblique angle with a longitudinal axis of the bore 76. The preferred angle of the elements of the surface 64 with respect to the longitudinal axis of the bore 76 is about 110°. Thus, the elements of the concave surface 64 form an acute angle with respect to a vertical line in a vertical plane passing through the nozzle 78 and the concave surface 64.

The concave surface 64 thus is positioned in a confronting, spaced relationship to the nozzle opening 78 and is shaped to deflect fluid projecting from nozzle opening 78 into a shaped pattern on a surface beneath the spray nozzle 40 as viewed in FIG. 4. The concavity of the deflector surface 64 is selected to narrow the width and forces the spray pattern on the surface to a predetermined width at a distance from the nozzle 40. For example, the radius of curvature of the concave surface can range between 1 and 10 inches, with 0.5 inch being preferred.

In operation, as pressurized cleaning solution is supplied to the solution conduit 24 from a suitable source such as a pump in the housing 14, the fluid enters the spray nozzle 40 through the opening 72 and passes through the fluid chamber 70 to the fluid bore 76 and ultimately out the nozzle opening 78. Preferably, the nozzle opening 78 is circular in cross section and has a smaller cross-sectional area than the fluid chamber 70. The successive reductions in the cross-sectional area of the solution conduit 24, the fluid chamber 70, and the fluid bore 76 results in an increase in the fluid pressure passing through the nozzle opening 78 for the uniform application of cleaning solution fluid as it exits the nozzle opening 78. The pressurized fluid passing through the circular nozzle opening 78 is emitted desirably as a focused, circular, pinpoint spray pattern. Portions of the fluid stream striking the surface 64 tend to be somewhat dispersed and cause a divergence of the spray pattern on the surface to be cleaned. The pinpoint pattern strikes the concave deflector surface 64 and is deflected downwardly toward the surface to be cleaned. The concavity of the deflector surface 64 tends to decrease the lateral angle of deflection of the divergent water particles which strike the surface 64 and to narrow the width of the spray pattern as compared to a substantially planar deflector surface. The benefit of containing the width of the fan-shaped spray pattern for the spray nozzle is enhanced as the fluid flow rate and fluid pressure are increased due to the fact that the divergence of the fluid stream increases with higher pressures.

As a general rule, the cleaning performance of a water extraction cleaning machine will be improved, up to a certain level, with increasing cleaning solution flow rates and pressure. One limiting factor for increasing the flow rates in the past has been effectively controlling the spray pattern of the spray nozzle. The concave deflector surface overcomes these problems because the concave surface reduces the width of the spray pattern by reducing the angle of deflection of some of the divergent fluid particles compared with a substantially planar deflector plate. With this structure, fluid flow rates and fluid pressure levels for water extraction cleaning machines can be increased over those that are currently known and used.

The shape of the deflector plate as seen in FIG. 5 is a cylindrical surface. It will be appreciated that modifying the radius of the arc will impact the spray pattern produced thereby. A shorter radius arc will result in a narrower spray pattern for a prescribed fluid flow rate as compared to a longer radius arc.

Figure 6:
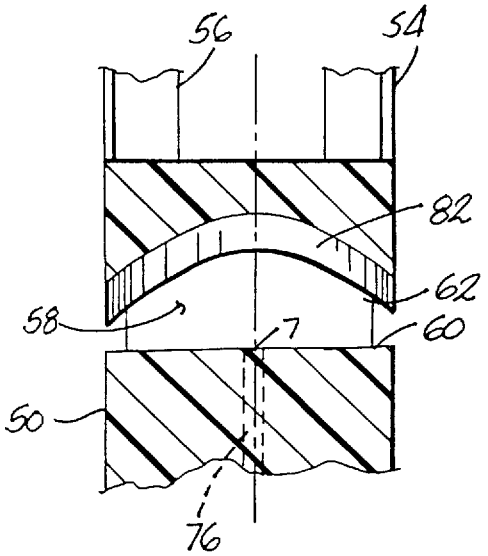
FIG. 6 is a cross-sectional view similar to FIG. 5 illustrating a second embodiment of a concave deflector plate according to the invention.
Figure 7:
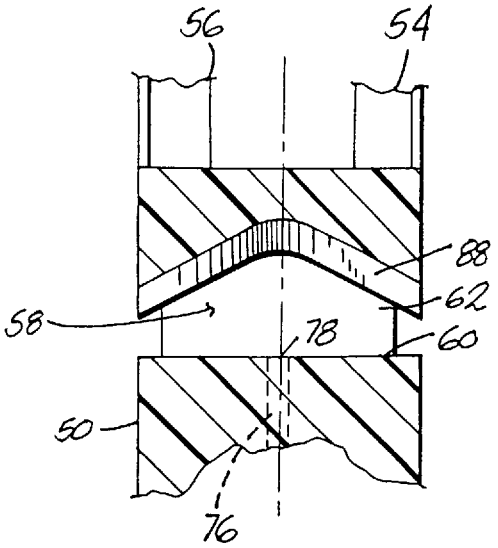
FIG. 7 is a cross-sectional view similar to FIG. 5 illustrating a third embodiment of a concave deflector plate according to the invention.

The contour of the concave deflector surface 64 can vary to suit the particular application. For example, the deflector plate 82 can be contoured to have a parabolic shape generated by rotating elements of a surface through a parabolic curve about an axis as shown in FIG. 6. Alternatively, as shown in FIG. 7, a hyperbolic surface could be formed on the deflector plate 88 by rotating an element of a surface 64 about a hyperbolic curve about an axis. These varying surfaces can be coordinated with the expected fluid flow rate and pressure to create a desired spray pattern.

Reasonable variation and modification are possible within the spirit of the foregoing specification and drawings without departing from the scope of the invention.

The embodiments for which an exclusive property or privilege is claimed are defined as follows:

1. An improved spray nozzle adapted to receive fluid under pressure from a suitable source and distribute the fluid in a desired spray pattern. The nozzle comprising a nozzle body having a bore therethrough with an inlet opening and an outlet opening forming a flow path; a deflector surface in spaced, confronting relationship with the outlet opening for deflecting a fluid stream under pressure from the outlet opening into a spray pattern on a surface to be cleaned, the deflector surface comprising a first side edge, second side edge, and an intermediate portion being disposed between the first and second side edges and the deflector surface is concave toward the bore outlet opening: a spray opening beneath the bore outlet and adjacent the deflector surface for passage of liquid in a spray pattern deflected from the deflector surface; and the improvement comprising:

the first and second side edges are laterally positioned closer to the plane of the outlet opening than the intermediate portion to thereby focus the spray pattern on a work surface.

2. A spray nozzle according to claim 1 wherein the bore has a longitudinal axis and the concave deflector surface is defined by rotating an element of the deflector surface about an axis of rotation which is at an obtuse angle to the longitudinal axis of the bore.

3. A spray nozzle according to claim 2 wherein the concave surface is defined by rotating the element of the surface through a circular arc.

4. A spray nozzle according to claim 3 wherein the radius of curvature of the circular arc is in the range of 0.1 to 10 inches.

5. A spray nozzle according to claim 3 wherein the angle of the element of the surface with respect to the longitudinal axis of the bore is in the range of 90° to 135°.

6. A spray nozzle according to claim 2 wherein the concave surface is defined by rotating the element of the surface through a parabolic curve.

7. A spray nozzle according to claim 2 wherein the concave surface is defined by rotating the element of the surface through a hyperbolic curve.

8. A spray nozzle according to claim 2 wherein the angle of the element of the surface with respect to the longitudinal axis of the bore is in the range of 90° to 135°.

9. A spray nozzle according to claim 1 wherein the bore decreases in cross-sectional area between the inlet and the outlet openings.

10. In an improved water extraction cleaning machine comprising a source of pressurized cleaning solution, a vacuum motor for generating a working air flow, a reservoir for retaining used cleaning solution and dirt and dust entrained therein, a vacuum hose having one end in fluid communication with the vacuum motor through the reservoir, a solution conduit having one end in fluid communication with the source of pressurized cleaning solution, a cleaning tool mounted to the other end of the vacuum hose, the cleaning tool having a suction nozzle in fluid communication with the vacuum hose, the spray nozzle mounted to the cleaning tool for depositing a spray pattern of pressurized cleaning solution adjacent to the suction nozzle, the spray nozzle having a nozzle body with a bore therethrough, the bore having an inlet opening at one end connected to another end of the solution conduit and an outlet opening at the other end of the bore, a deflector surface in spaced, confronting relationship with the bore outlet opening for directing fluid pressure from the bore outlet opening in a spray pattern onto a surface to be cleaned the deflector surface comprising a first side edge, second side edge, and an intermediate portion disposed between the first and second side edges and the deflector surface is concave toward the bore, and a spray opening in the nozzle body beneath the nozzle outlet and adjacent to the deflector surface for passage of liquid in a spray pattern deflected from the deflector surface, the improvement comprising:

the first and second side edges are positioned closer to the plate of the outlet opening than the intermediate portion to laterally focus the spray pattern on the work surface.

11. A water extraction cleaning machine according to claim 10 wherein the bore decreases in cross-sectional area between the inlet and the outlet thereof.

12. In an improved water extraction cleaning machine comprising a source of pressurized cleaning solution, a vacuum motor for generating a working air flow, a reservoir for retaining used cleaning solution and dirt and dust entrained therein, a vacuum hose having one end in fluid communication with the vacuum motor through the reservoir, a solution conduit having one end in fluid communication with the source of pressurized cleaning solution, a cleaning tool mounted to the other end of the vacuum hose, the cleaning tool having a suction nozzle in fluid communication with the vacuum hose, the spray nozzle mounted to the cleaning tool for depositing a spray pattern of pressurized cleaning solution adjacent to the suction nozzle, the spray nozzle having a nozzle body with a bore therethrough, the bore having an inlet opening at one end connected to another end of the solution conduit and an outlet opening at the other end of the bore, a deflector surface in spaced, confronting relationship with the bore outlet opening for directing fluid pressure from the bore outlet opening in a spray pattern onto a surface to be cleaned the deflector surface comprising a first side edge, second side edge, and an intermediate portion disposed between the first and second side edges and the deflector surface is concave toward the bore, and a spray opening in the nozzle body beneath the nozzle outlet and adjacent to the deflector surface for passage of liquid in a spray pattern deflected from the deflector surface, the improvement comprising:

the deflector surface being concave toward the bore outlet opening, and the bore having a longitudinal axis and the concave deflector surface is defined by rotating an element of the deflector surface about an axis of rotation which is at an obtuse angle to the longitudinal axis of the bore.

13. A water extraction cleaning machine according to claim 12 wherein the concave surface is defined by rotating an element of the surface through a circular curve.

14. A water extraction cleaning machine according to claim 13 wherein the radius of curvature of the circular arc is in the range of 0.1 to 10 inches.

15. A water extraction cleaning machine according to claim 14 wherein the angle of the element of the surface with respect to the longitudinal axis of the bore is in the range of 90° to 135°.

16. A water extraction cleaning machine according to claim 12 wherein the concave surface is defined by rotating an element of the surface through a parabolic curve.

17. A water extraction cleaning machine according to claim 12 wherein the concave surface is defined by rotating an element of the surface through a hyperbolic curve.

18. A water extraction cleaning machine according to claim 12 wherein the angle of the element of the surface with respect to the longitudinal axis of the bore is in the range of 90° to 135°.

* * * * *

UNITED STATES PATENT AND TRADEMARK OFFICE

CERTIFICATE OF CORRECTION

PATENT NO.: 5,813,087

DATED: September 29, 1998

INVENTOR(S): ERIC C. HUFFMAN

It is certified that error appears in the above-identified patent and that said Letters Patent is hereby corrected as shown below:

Claim 10, col. 7, line 9, "plate" should read --plane--.

Signed and Sealed this

Twenty-third Day of February, 1999

*Attest:*

Q. TODD DICKINSON

*Attesting Officer*

*Acting Commissioner of Patents and Trademarks*